United States Patent [19]

Collier et al.

[11] 4,411,371

[45] Oct. 25, 1983

[54] HATCH COVER LOCKING MECHANISM

[76] Inventors: Lyn D. Collier, 7310 Woodland West Dr., Houston, Tex. 77040; Marvin Stark, 727 Wax Myrtle, Houston, Tex. 77079

[21] Appl. No.: 205,173

[22] Filed: Nov. 10, 1980

[51] Int. Cl.[3] ..... B65D 45/20; B65D 45/28

[52] U.S. Cl. ..... 220/314; 220/324

[58] Field of Search ..... 220/314, 324

[56] References Cited

U.S. PATENT DOCUMENTS

| | | | |
|---|---|---|---|
| 680,917 | 4/1901 | Helling | 220/324 |
| 1,033,496 | 7/1912 | Udkler | 220/324 |
| 1,371,955 | 3/1921 | VanBuren | 220/324 |
| 1,617,076 | 2/1927 | Mauser | 220/324 |
| 2,176,306 | 10/1939 | Kuss | 220/314 |
| 2,572,963 | 10/1951 | Wily | 220/314 |
| 3,179,287 | 4/1965 | Rickmeir | 220/324 |

*Primary Examiner*—George E. Lowrance

*Attorney, Agent, or Firm*—Conlon & Kerstein

[57] ABSTRACT

A locking device for a hatch cover is attached to a hinged carrier bar and has a flexible lock strip pivotally attached to the upper surface thereof and movable in a horizontal plane between a locked position underlying an associated roof top mounted latch member and an unlocked position rotated away from the latch member. The locking strip includes a handle which allows it to move in cantilever fashion whereby a locking finger on the flexible strip is lifted and removed from an associated locking opening allowing the strip to be rotated away from the latch to unlock the hatch cover.

5 Claims, 5 Drawing Figures

HATCH COVER LOCKING MECHANISM

BACKGROUND OF THE INVENTION (1) Field of the Invention

This disclosure pertains to a locking arrangement for hatch covers used on hoppers and in particular used on covered hopper cars in the railroad field.

(2) Description of the Prior Art

Prior art hatch locking arrangements have included a variety of mechanisms intended to overcome problems inherent in securely locking hatch covers. Other designs involve complicated and expensive mechanisms which are not able to withstand extreme environmental conditions. Prior art devices have included rotatable handles which have threaded shafts located around the periphery of hatch covers and upon rotation of the threaded members the hatch covers are engaged and securely held in place. One problem with this type of arrangement is the cost involved in manufacturing and assembling the three rotatable handles and the excessive time involved in locking a hatch cover utilizing such a mechanism.

The locking arrangement disclosed herein is composed of a number of simple members including a carrier bar which is attached to a hatch cover and hinged at one end and includes a flexible locking strip at the other end which engages a roof mounted latch. The hatch cover may be easily locked and unlocked by one person and contains a minimum number of mechanical components, thus reducing the chance of failure and providing a device which is easily operated in snow, ice, or other extreme weather conditions.

SUMMARY

This disclosure pertains to a locking mechanism for hatch covers used on railroad hopper cars. The hatch cover is attached to a carrier bar which is hinged at one end and includes a flexible locking strip at the other end. The hinge is arranged in such a fashion that a hinge pin is securely attached to the carrier bar and moves within an oversized opening of a hinge bracket formed at the end of the carrier bar. This oversized hinge arrangement allows the cover gaskets to seat securely on the flanges of the hatch coaming for improved sealing. The locking end of the carrier bar has a lock strip attached to the upper surface. The flexible locking strip moves pivotally in a horizontal plane to lock the hatch cover by engaging a latch member which is attached to the roof or hatch coaming of the vehicle. The car mounted latch fits through an opening in the carrier bar and includes a locking lip adapted to overlap the locking strip and thus lock the hatch cover securely in position.

The flexible locking strip includes a handle which may be easily grasped by an operator to move the locking strip in a cantilever fashion and lift a locking pin from an associated opening on the carrier bar thus permitting the locking strip to be rotated to a position clear of the latch to allow the cover to be open. The carrier bar also includes an extension allowing an operator to step on the carrier and thus depress the hatch covered gaskets to allow the latch and locking strip some momentary clearance in which the locking strip may be easily lifted and rotated to an unlocked position.

It is thus an object of this disclosure to provide a locking arrangement for hatch covers of covered hopper cars wherein a cover member is securely attached to a carrier bar having an oversized hinged connection allowing the cover to move easily between an open and closed position and also allowing the cover to possess a self-seating arrangement for sealing purposes.

Another object of this disclosure is to provide a locking arrangement wherein a flexible locking strip may be easily grasped by an operator, lifted to an unlocked position and then rotated clear of an associated locking latch to allow a hatch cover to be easily opened.

Yet another object of this disclosure is to provide a locking arrangement for a hatch cover of covered hopper cars in which the hatch cover is attached to a carrier bar and has an extension portion whereby the hatch cover may be momentarily depressed by the weight of an operator thus allowing clearance between the locking members and provide for easy movement of the locking members from a locked to an unlocked position. Similarly, when the hatch cover is locked, the extension may be momentarily depressed to allow the locking members to be aligned for locking purposes.

These and other objects of the disclosure will become apparent to those having ordinary skill in the art with reference to the following description, claims, and drawings.

DESCRIPTION

Figure 1:
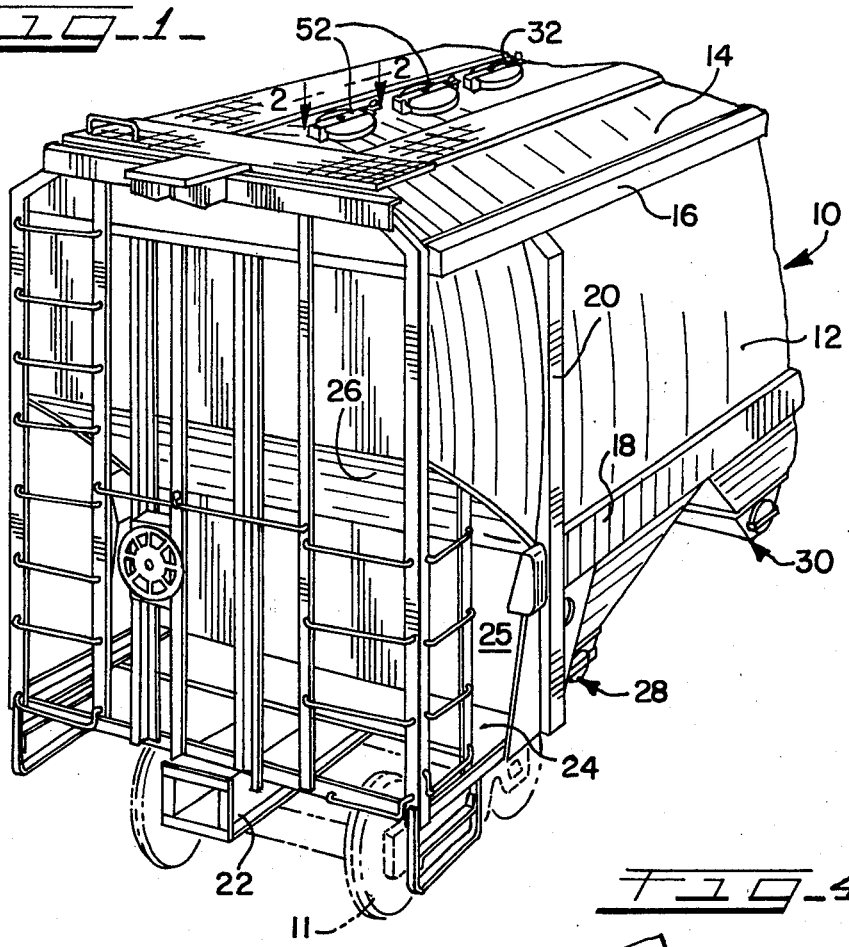
FIG. 1 is a perspective view of a railway covered hopper car having the hatch cover of the present invention.
Figure 4:
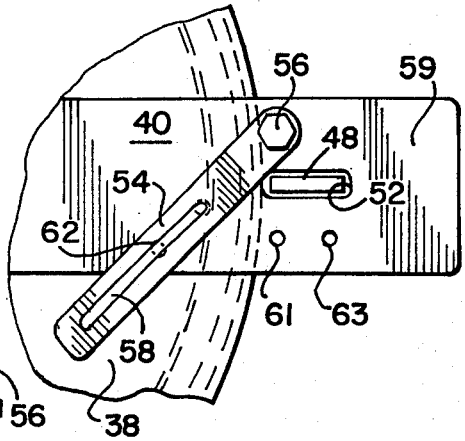
FIG. 4 is a partial top plan view similar to FIG. 2 with locking strip in a released position.
Figure 5:
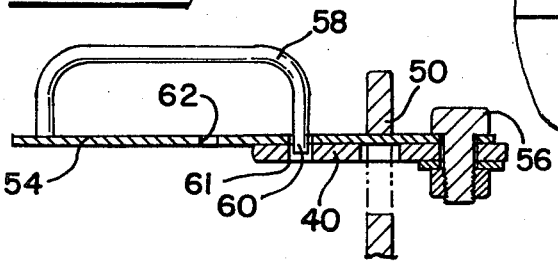
FIG. 5 is a cross-sectional view of the locking strip.

Referring now to the drawings, and in particular to FIG. 1 there is shown a railway covered hopper car 10 supported on a pair of trucks 11 and having curved sides 12 interconnected by curved roof sheets shown generally by the numeral 14. Framing arrangement of the car also includes top cord or side plate 16 extending the length of the vehicle and running parallel with a side sill beam 18 also located on each side of the vehicle and running generally from bolster beams 20. The vehicle also includes the usual draft sill 22 and end framing which may include a horizontally located shear plate 24 overlying the draft sill 22. An upwardly extending bolster web plate 25 may be utilized to reinforce the end slope sheet 26 which is used to direct lading from the end hoppers of the vehicle. Lading carried within the hoppers is discharged by a pneumatic or gravity feed discharge arrangement and for purposes of illustration a pneumatic outlet 28 is shown in this disclosure. An intermediate hopper may also be discharged by a pneumatic outlet which is designated by the numeral 30.

Figure 3:
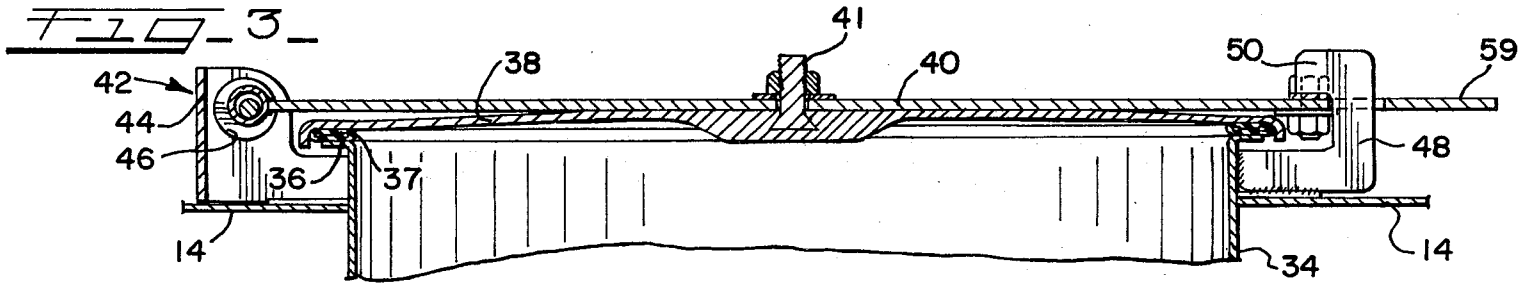
FIG. 3 is a cross-sectional view taken along line 3—3 of FIG. 2.

Lading is loaded into the vehicle through the hatches 32 located on the roof of the vehicle. As shown in FIG. 3, the hatch 32 includes upstanding coaming 34 which is fitted within openings in the roof sheet 14. The top portion of coaming 34 includes a horizontal or rounded flange 36 which mates with a gasket 37 attached to the underside of the cover 38.

Figure 2:
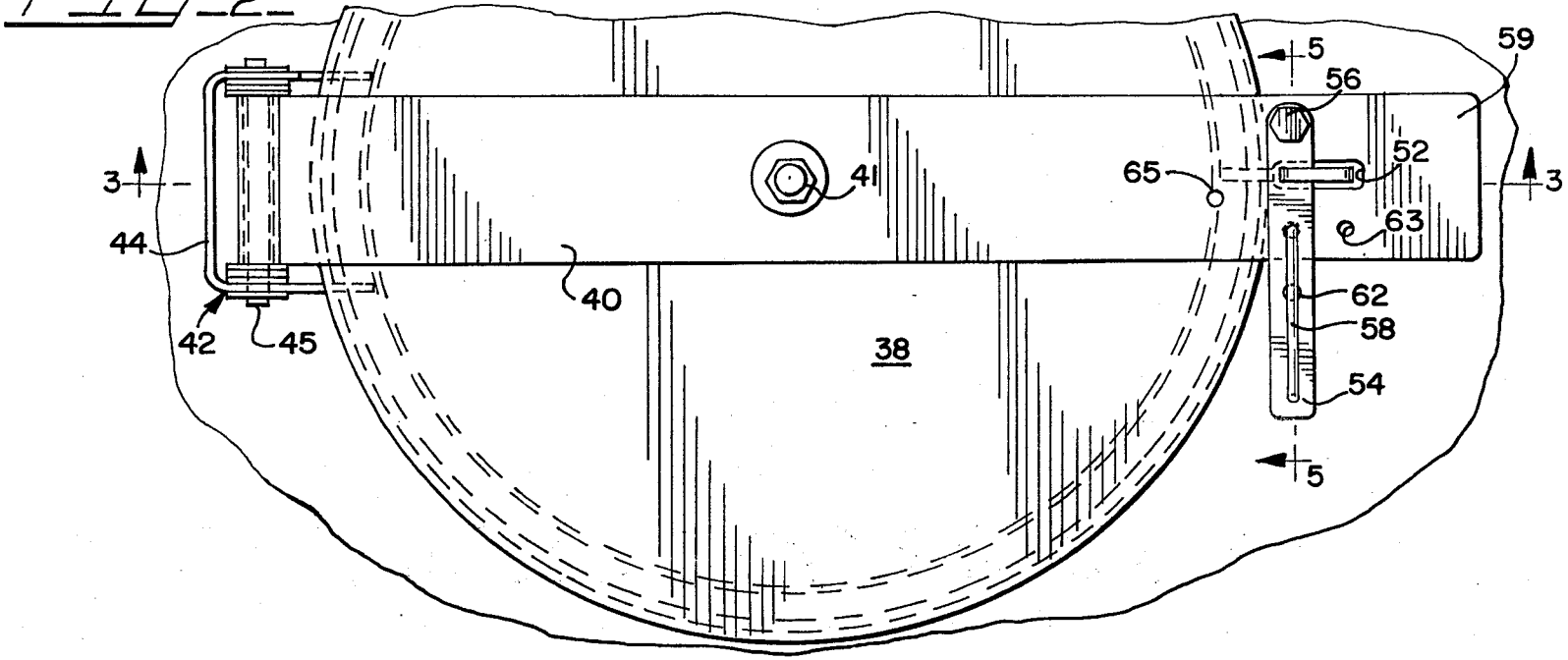
FIG. 2 is a top plan view of the locking device of the present invention.

As shown in FIGS. 2 and 3, the cover 38 is attached to a carrier bar 40 by a suitable mechanical connector 41 in such a fashion that when the carrier bar 40 is moved the cover 38 also moves. Further, when the carrier bar 40 is depressed downwardly, forces are evenly distributed from the center of the cover 38 outwardly around the periphery to depress the gasket 37 and guarantee a tight seal around the hatch opening.

On one end of the carrier bar 40 is part of a hinged connection 42 which includes an upstanding, U-shaped bracket 44 attached to roof sheet 14. The hinged end of carrier bar 40 provides a tube type of oversize hinge 46 which receives the hinge pin 45 and provides a floating connection which insures a tightly sealed hatch opening with new, high gaskets as well as when the gasket 37 is worn and flattened. Further, because cover 38 has a dome shape and carrier bar 40 is essentially flat, a spacing occurs between bar 40 and the edges of cover 38 (FIG. 3). This spacing allows the carrier bar 40 to function as a flat spring to urge the cover 38 downwardly and allow for some limited deflection of bar 40 when being locked when an operator depresses the extension portion 59.

The right side of the carrier bar 40 is illustrated in FIGS. 2 and 3 and includes a lock arrangement. An upstanding latch 48 is securely attached to the roof of the vehicle and/or to the coaming 34. The latch 48 includes a cutout or lip portion 50 and is located to extend through an opening 52 in carrier bar 40 when the cover 38 is closed. A flexible locking strip 54 is pivotally attached with a mechanical fastener 56 to the top side of the carrier bar 40 and is adapted to rotate about fastener 56 to lock and unlock the cover 38. More specifically, locking strip 54 includes a handle 58 which may be easily grasped by an operator allowing a locking finger 60 to move out of opening 61 and permit the strip 54 to be rotated outwardly from the underside of lip 50. It should be noted that the carrier strap 40 also includes an extension 59 upon which a person opening the hatch may apply weight by hand or by foot in order to momentarily depress the gasket 37 and provide clearance between the latch 50 and the lock strip 54 to allow the lock strip 54 to be easily lifted in cantilever fashion and then rotated from the underside of the lip 50. When in the locked position, shown in FIG. 2, the openings 62 and 63 may be used for insertion of a car seal. Another opening 65 located in the carrier bar 40 is provided to receive the locking finger 60 and hold the flexible locking strip 54 in an unlocked position as the cover is swung over and away from the hatch opening.

It should also be noted that the hinge bracket 44 is designed in such a fashion that the back edge extending between the sides is high enough to support the cover in a raised position off the roof of the vehicle so that when the hatch is opened the hatch cover does not contact the roof sheets 14 and consequently does not nick, scratch, or discolor the roof sheets.

In closing the hatch cover, an operator merely grasps the carrier bar extension 59 and moves the cover in a rotational fashion until the latch 48 is positioned within the slotted opening 52 of the carrier strap 40. If necessary, the operator may then step on the extension 59 and depress the gasket 37 to provide a momentary clearance between the locking lip 50 and the lock strip 54. At that time, the operator would then grasp handle 58 lifting it in cantilever fashion to remove the finger 60 from the opening 65 and then rotating the lock strip 54 in a counterclockwise direction, as shown in FIG. 2, until the locking finger 60 is aligned with the associated opening 61 on the carrier bar 40. At that time, the handle may be released and the operator removes weight from the extension 59 resulting in the cover 38 securely locked in a closed position.

Thus it has been shown by the foregoing disclosure and description of the operation that the locking mechanism shown herein permits a hatch cover to be locked securely with components that are easily manufactured and highly reliable even in the most severe weather conditions.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A locking mechanism for hatch covers used on covered hopper cars, the improvement comprising:

a hatch cover movable between an open and a closed position about a hatch opening;

a carrier bar having means attached to the hatch cover;

hinge means located at one end of the carrier bar;

a latch;

means securely mounting the latch to the hopper car;

a locking strip comprising a flexible member having one end attached to the carrier bar for pivotal movement of the strip and having a free end, said locking strip having a locking portion engageable with the latch;

grasping means attached to the flexible member for lifting the free end and moving the flexible member into and from engagement with the latch;

said locking strip having retaining means for holding the strip in position on the carrier bar;

said retaining means including an opening and finger means adapted to fit into said opening for securely holding the flexible member in position; and, said finger means and opening becoming disengaged upon flexing of the flexible member.

2. The locking mechanism of claim 1 wherein said hinge means includes:

a first hinge member having an oversize hinge pin opening cooperative with said carrier bar having a tube type oversize hinge opening at one end thereof and further cooperative with a smaller diameter hinge pin to provide a floating hinge and hinge pin connection to provide an improved seal of the hatch cover above the hatch opening.

3. The locking mechanism of claim 1 wherein:

said hatch cover has a dome shape with a raised central portion and portions tapering downwardly away from the dome to the cover edge;

said carrier bar having said means attached to the hatch cover comprising a fastener located at the dome of the cover;

said carrier bar having a flat portion extending between the hinge means and the latch and providing a space between the carrier bar and the cover edge whereby the carrier bar is permitted a limited amount of deflection and downward movement.

4. The locking mechanism of claim 1 wherein said carrier bar includes:

a slotted opening with means adapted to fit about the latch when the hatch cover is in the closed position;

said means mounted to the carrier bar for attaching the locking strip including means located adjacent the opening for locating the flexible strip at right angles to the carrier bar when in the locked position.

5. The locking mechanism of claim 1 wherein the carrier bar includes:

an extension protruding outwardly of the cover and providing a surface for applying pressure to assist in locking and unlocking the hatch cover.

* * * * *